US007384502B2

(12) United States Patent
Kamijo et al.

(10) Patent No.: US 7,384,502 B2
(45) Date of Patent: Jun. 10, 2008

(54) PROCESS FOR IMPREGNATING, REFINING, AND BLEACHING WOOD CHIPS HAVING LOW BLEACHABILITY TO PREPARE MECHANICAL PULPS HAVING HIGH BRIGHTNESS

(75) Inventors: Yasuyuki Kamijo, Tokyo (JP); Isao Onodera, Tokyo (JP); Keigo Watanabe, Tokyo (JP); Takanori Miyanishi, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 10/730,006

(22) Filed: Dec. 9, 2003

(65) Prior Publication Data

US 2004/0118529 A1 Jun. 24, 2004

(30) Foreign Application Priority Data

Dec. 24, 2002 (JP) ..... 2002-372100
Dec. 24, 2002 (JP) ..... 2002-372677

(51) Int. Cl.
*D21B 1/16* (2006.01)
*D21C 9/10* (2006.01)
*D21C 9/02* (2006.01)
*D21C 1/06* (2006.01)

(52) U.S. Cl. ..... 162/25; 162/18; 162/27; 162/28; 162/56; 162/60; 162/71; 162/90; 162/91

(58) Field of Classification Search ..... 162/18, 162/25, 27, 28, 52, 56, 60, 70, 71, 76, 78, 162/90, 91
See application file for complete search history.

(56) References Cited

U.S. PATENT DOCUMENTS 2,687,943 A * 8/1954 Pete ..... 162/71
2,956,918 A * 10/1960 Snyder ..... 162/90
3,023,140 A * 2/1962 Textor ..... 162/24
4,116,758 A * 9/1978 Ford et al. ..... 162/28
4,160,693 A * 7/1979 Lindahl et al. ..... 162/24

(Continued)

FOREIGN PATENT DOCUMENTS

| | | | |
|---|---|---|---|
| EP | 0 494 519 | * | 7/1992 |
| JP | 56-85488 | | 7/1981 |
| JP | 59-15589 | | 1/1984 |
| JP | 59-17240 | | 4/1984 |
| JP | 63-58957 | | 11/1988 |
| JP | 63-58958 | | 11/1988 |
| JP | 2002-294574 | * | 10/2002 |
| WO | WO 9002835 A1 | * | 3/1990 |

OTHER PUBLICATIONS

Rydholm, Sven A., Pulping Processes, Sep. 1967, Interscience Publishers, p. 548.*

(Continued)

*Primary Examiner*—Eric Hug
(74) *Attorney, Agent, or Firm*—Roylance, Abrams, Berdo & Goodman, L.L.P.

(57) ABSTRACT

Wood chips having low bleachability are impregnated with a chemical liquor at a pH range of 7-12 in aqueous solution and the chemical liquor from the impregnated chips is drained, whereby extractives contained in the chips and consuming bleaching agents can be removed to improve the effect of bleaching agents in a subsequent bleaching step. Bleached mechanical pulp is prepared by defibration by primary refining—bleaching—beating by secondary refining wherein pulp fibers are washed after defibrating wood chips having low bleachability and before bleaching the pulp fibers, whereby the amount of bleaching agents used can be reduced and bleached mechanical pulp having a Hunter brightness of 45-65% after secondary refining can be obtained.

14 Claims, 2 Drawing Sheets

U.S. PATENT DOCUMENTS

| | | | | | |
|---|---|---|---|---|---|
| 4,247,362 | A | * | 1/1981 | Williams | 162/13 |
| 4,279,694 | A | * | 7/1981 | Fritzvold et al. | 162/28 |
| 4,486,267 | A | * | 12/1984 | Prusas | 162/25 |
| 4,502,918 | A | | 3/1985 | Mackie et al. | |
| 4,599,138 | A | * | 7/1986 | Lindahl | 162/19 |
| 4,789,429 | A | * | 12/1988 | Jackson et al. | 162/24 |
| 4,798,651 | A | * | 1/1989 | Kokta | 162/22 |
| 4,812,206 | A | * | 3/1989 | Devic et al. | 162/19 |
| 4,849,053 | A | * | 7/1989 | Gentile et al. | 162/76 |
| 4,900,399 | A | * | 2/1990 | Bengtsson et al. | 162/26 |
| 5,002,635 | A | * | 3/1991 | Gentile et al. | 162/76 |
| 5,433,825 | A | * | 7/1995 | Minor et al. | 162/86 |
| 5,607,546 | A | * | 3/1997 | Höglund et al. | 162/25 |
| 6,743,332 | B2 | * | 6/2004 | Haynes et al. | 162/78 |
| 7,018,509 | B2 | * | 3/2006 | Kilgannon et al. | 162/24 |
| 2001/0050151 | A1 | * | 12/2001 | Sabourin | 162/19 |
| 2003/0006016 | A1 | * | 1/2003 | Tienvieri et al. | 162/20 |
| 2004/0069427 | A1 | * | 4/2004 | Xu | 162/78 |

OTHER PUBLICATIONS

Eric Cannell, Mechanical Pulping Technologies Focus on Reducing Refining Energy, 1999, Pulp & Paper, http://www.paperloop.com/db_area/archive/p_p_mag/1999/9905/focus4.htm.*

G. A. Smook, Handbook for Pulp & Paper Technologists, 1982, TAPPI and Canadian Pulp and Paper Association, pp. 94, 95, and 99.*

Jackson, "The Interaction of Wood Species and Wood Quality with the TMP Process—A Review", TAPPI Proceedings, Pulping Conference, pp. 455-465, (1998).

* cited by examiner

PROCESS FOR IMPREGNATING, REFINING, AND BLEACHING WOOD CHIPS HAVING LOW BLEACHABILITY TO PREPARE MECHANICAL PULPS HAVING HIGH BRIGHTNESS

BACKGROUND OF THE INVENTION

The present invention relates to processes for preparing mechanical pulps having high brightness from wood chips having low bleachability, and more specifically to a pretreatment for extracting causative factors responsible for low bleachability from wood chips having low bleachability.

As for mechanical pulps, the main properties of their quality depend on the nature of the wood fibers from which they are prepared. However, even wood species previously known to be unsuitable for mechanical pulps have recently been used as starting materials because of changes in the demand for application of wood and pulp quality as well as changes in the supply of forest resources relating to the momentum of environmental protection. These wood species used as starting materials often fail to meet desired qualities when they are converted into pulps under conventional process conditions. On the other hand, high value-added papers such as lightweight coated (LWC) paper and supercalendered (SC) paper have recently attracted attention as grades of papers containing mechanical pulps, so that there are demands for a technique for preparing pulps with a quality comparable to or higher than those of conventional pulps from starting materials unsuitable for mechanical pulps.

M. Jackson mentions conifers such as Douglas fir, Jack pine and Larch as starting materials unsuitable for mechanical pulps in 1998 Tappi Pulping Conf. Proc. pp. 455-465. These materials are especially disadvantageous in their low brightness and they require large quantities of bleaching agents such as hydrogen peroxide during the bleaching step to attain a desired brightness because they contain high levels of polyphenolic extractives which consume bleaching agents.

In particular, these species have the disadvantage that the heartwood is colored because it contains high levels of extractives. Mechanical pulps prepared from sapwood alone seem to have qualities closely comparable to those obtained from conventional wood species, but the brightness is lowered when heartwood containing higher levels of extractives than sapwood is included in starting materials and large quantities of bleaching agents have to be added to reach a desired brightness.

Prior techniques for improving the brightness of mechanical pulps are described in several prior applications as follows. JPA SHO 56-85488 discloses a technique comprising pretreating wood chips with 0.5-3.0% by weight of an alkali on the basis of bone dry chips and 0.2-0.7 times the amount of hydrogen peroxide based on the alkali before bleaching them with hydrogen peroxide in a refiner. Japanese Patent No. 1240510 describes a process for preparing bleached mechanical pulp from wood chips, comprising defibrating wood chips in the presence of an organic chelating agent and a sulfite and then bleaching unbleached pulp with a peroxide. Japanese Patent No. 1515223 describes a refiner bleaching technique for preparing bleached mechanical pulp by refining wood chips in the presence of an alkaline hydrogen peroxide bleaching solution, comprising primary refining with an alkaline hydrogen peroxide bleaching solution containing an alkali in an amount enough to attain, after primary refining, pH 9.0-11.0, and then, after primary refining, adding 0.05-3.0% by weight of a mineral acid on the basis of bone dry pulp during the period from the instant immediately after primary refining to the instant immediately before secondary refining, followed by secondary refining. Japanese Patent No. 1515224 describes a refiner bleaching technique for preparing bleached mechanical pulp by refining wood chips in the presence of an alkaline hydrogen peroxide bleaching solution, comprising primary refining with an alkaline hydrogen peroxide bleaching solution containing an alkali in an amount enough to attain pH 7.0-9.0 exclusive after primary refining and then, before secondary refining, adding an alkaline material in an amount equivalent to 5-50% of the amount of the alkali added during primary refining, followed by secondary refining. JPA SHO 59-15589 discloses a process for preparing mechanical refiner wood pulp, comprising a two-stage treatment using sodium sulfite before and after primary refining.

However, none of these prior techniques focused attention on the fact that extractives such as polyphenols contained in conifers are causative factors for lowered brightness, nor did they intend to positively remove these factors to improve the brightness of the resulting bleached mechanical pulp. It would be desirable to develop a novel technique capable of preparing bleached mechanical pulp having high brightness from materials having low bleachability containing high levels of extractives.

The present invention aims firstly to provide a novel technique capable of preparing bleached pulp having high brightness from materials having low bleachability containing high levels of extractives and secondly to provide a technique capable of reducing the amount of bleaching agents used in processes for preparing bleached mechanical pulps.

SUMMARY OF THE INVENTION

A first aspect of the present invention relates to a pretreatment comprising impregnating wood chips having low bleachability with a chemical liquor at a pH range of 7-12 in aqueous solution and draining the chemical liquor from the impregnated chips, whereby extractives contained in the chips and consuming bleaching agents can be removed, with the result that the effect of bleaching agents in the subsequent bleaching step can be improved and bleached mechanical pulp having high brightness can be prepared.

Accordingly, the first aspect of the present invention provides a process for preparing bleached mechanical pulp having high brightness from wood chips comprising the steps of impregnating wood chips having low bleachability with a chemical liquor at a pH range of 7-12 and then removing the impregnated chemical liquor from the chips, followed by a sequential step of (a) defibration by primary refining, bleaching, and beating by secondary refining, or (b) defibration by primary refining, beating by secondary refining and bleaching.

A second aspect of the present invention relates to a process for preparing bleached mechanical pulp comprising a sequential step of defibration by primary refining—bleaching—beating by secondary refining wherein pulp fibers are washed after defibrating wood chips having low bleachability and before bleaching the pulp fibers, whereby the amount of bleaching agents used can be reduced, and bleached mechanical pulp having a Hunter brightness of 45-65% after secondary refining can be obtained.

Accordingly, the second aspect of the present invention provides a process for preparing bleached mechanical pulp having high brightness, comprising the steps of defibrating wood chips by primary refining, washing pulp fibers formed by defibration, bleaching the pulp fibers, and further beating them by secondary refining to give bleached mechanical pulp having a Hunter brightness of 45-65%.

DETAILED DESCRIPTION OF THE INVENTION

Figure 1:
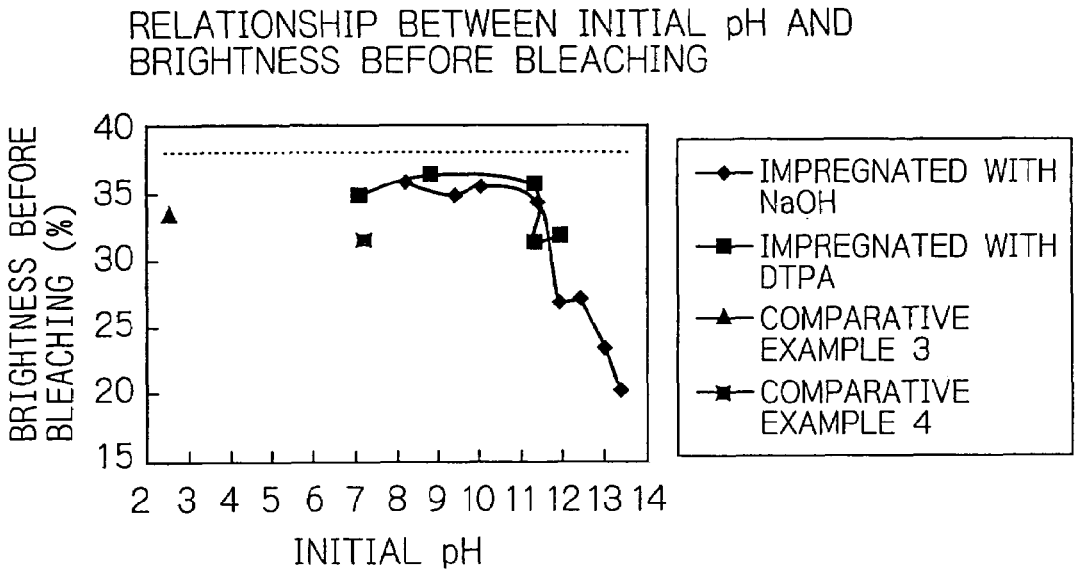
FIG. 1 is a graph showing the relationship between initial pH and brightness before bleaching.

Wood chips having low bleachability to be treated by the present invention, that is, those containing high levels of flavonoids, include Larix, Pseudotsuga, Cryptomeria, Tsuga, Thuja and Pinus (e.g. Jack pine), and they can be applied as single chips or mixed chips to the present invention.

In the first aspect of the present invention, a pretreatment is performed prior to defibration by primary refining in the preparation of bleached mechanical pulp, which comprises impregnating the above mentioned wood chips having low bleachability with a specific chemical liquor, and then draining the impregnating solution to eliminate extractives to the outside of the system, thereby extracting/removing flavonoids, lignin and/or metals (including metal ions) from the chips having low bleachability. This chemical impregnation can be achieved by compressing the wood chips having low bleachability, immersing the chips under compression or after compression in the chemical liquor and releasing pressure to expand the chips and impregnate the chips with the chemical liquor. In this chemical impregnation step, it is important to sufficiently impregnate the chemical liquor into the wood chips having low bleachability. Such compression and impregnation is preferably performed using an Impressafiner system from Andritz. Prex screws from Metso can also be used. It is important that the compression ratio is 4:1-16:1, and compression ratios of lower than 4:1 are not preferred because the chips are poorly reconstituted so that the chemical liquor does not sufficiently penetrate into the chips. Compression ratios exceeding 16:1 are mechanically impractical. The compression ratio is defined as the ratio of the volume before compression to the volume after compression. If the wood chips are pretreated with water vapor before compression, the chips are softened and become easier to compress and impregnate with a chemical liquor. If compressed wood chips are immersed in a chemical liquor and the compression ratio of the wood chips is continuously changed to impregnate the chemical liquor into the wood chips, the chemical liquor can be efficiently penetrated and the costs for facilities for chemical impregnation can be reduced.

In the first aspect of the present invention, the initial pH during extraction by chemical impregnation is preferably 7-12. Therefore, the pH of the impregnating chemical liquor used is preferably in the range of 7-12. Specific examples of such impregnating agents include, e.g. aqueous solutions of alkaline inorganic compounds such as sodium hydroxide and potassium hydroxide, preferably aqueous sodium hydroxide solutions. Aqueous solutions of inorganic materials based on said alkaline inorganic compounds can also be used. Chelating agents at pH 7-12 in aqueous solution have good effects. Chelating agents include, e.g. diethylenetriaminepentaacetic acid, 2-hydroxyethylethylenediaminetriacetic acid, ethylenediaminetetraacetic acid, diethylenetriaminepenta(methylenephosphonic)acetic acid, or alkaline metal salts thereof. If said chelating agents in aqueous solution are acidic, they must be mixed with said alkaline inorganic compounds.

Wood chips having low bleachability to be treated by the present invention contain high levels of extractives such as flavonoids, which consume bleaching agents added during the subsequent bleaching step. These substances can be extracted from the chips, and the consumption of bleaching agents can be limited by extraction at the initial pH=7-12.

Flavonoids have the property of forming complexes with metal ions to cause coloration. The treatment with a chelating agent at pH 7-12 in aqueous solution has the effect of inhibiting complexation of flavonoids with metal ions to prevent coloration by extracting flavonoids and simultaneously removing metal ions in the extractives with the chelating agent. It is known that if metal ions are present in the system during bleaching with an alkaline peroxide after primary refining, they decompose the peroxide. According to an outline of hydrogen peroxide bleaching written by Hosoya (S. Hosoya, Japan Tappi J., 52(5), 595(1998)), it is known that metal ions such as $Fe^{2+}$, $Cu^{2+}$, $Co^{2+}$ and $Mn^{2+}$ are contained in wood. Bleaching is achieved by oxidative decomposition of lignin in wood with an alkaline peroxide, but the alkaline peroxide is decomposed by the catalytic action of any coexisting metal ions to decrease the bleaching efficiency. Therefore, the treatment with a chelating agent also has the effect of improving the efficiency of alkaline peroxide bleaching agents in the bleaching step.

Although the effect of the first aspect of the present invention can be achieved by rapid chemical impregnation and drainage, the chips impregnated with the chemical liquor can also be maintained in order to improve the extraction efficiency and the efficiency of the complexation reaction of chelating agents with metal ions and further to soften the chips. Conditions for this depend on the type and size of wood chips, but normally involve a temperature of 10-95° C., more preferably 0.60-80° C. for a period of 5-60 minutes, preferably 5-30 minutes.

Then, the chips impregnated with the chemical liquor are compressed again to remove extractives contained in the chips. During this step, metal ions and extractives are eliminated from the system by compressing the chips impregnated with the chemical liquor, thus improving the alkaline peroxide bleaching efficiency during the subsequent bleaching step. The compressor used in this step is similar to the compressor used for the chemical impregnation described above. It is important that the compression ratio is at least 4:1-16:1, and if the compression ratio is lower than 4:1, the brightness of the resulting pulp is lowered because it is influenced by substances remaining in the chips. Compression ratios exceeding 16:1 are mechanically impractical.

After completion of chemical impregnation and extraction, the chips are at first defibrated into pulp fibers under known conditions in a pressurized or atmospheric refiner in a primary refining step. Refining may be sufficiently accomplished in any one of conventional defibrators, preferably single disc refiners, conical disc refiners, double disc refiners, twin disc refiners, etc. The concentration of bleached chips during the refining step is preferably about 20-60%.

Next, the second aspect of the invention is explained.

Wood chips having low bleachability are initially subjected to primary refining. They are defibrated into pulp fibers under known conditions in a pressurized or atmospheric refiner. Refining may be sufficiently accomplished in any one of conventional defibrators, preferably single disc refiners, conical disc refiners, double disc refiners, twin disc refiners, etc. The concentration of bleached chips during the refining step is preferably about 20-60% solids by weight at a temperature of 100-180° C., more preferably 120-135° C. For the purpose of better defibration, primary refining is preferably preceded by preheating at a temperature of 100-135° C.

Then, defibrated pulp is diluted to a concentration of 0.5-5.0%, preferably 0.5-2.0%, more preferably 1.0-2.0% and washed, and then dehydrated/concentrated to a concentration of 10-40%, preferably 10-20%, more preferably 10-16%. The diluent used is water at a temperature of 5-95° C. During this step, anionic trashes such as polyphenols derived from extractives of wood chips having low bleachability are removed. The dehydrator/concentrator used may be a conventional pulp dehydrator/concentrator such as Model 575 Dewatering Press, Andritz. The washing efficiency in washing according to the present invention is 52.6-99.2%, when it is defined as "the ratio of water removed to water that existed before washing". However, it is preferably 52.6-94.7%, more preferably 65.0-94.7%.

In the first aspect of the invention, defibrated pulp is transferred to secondary refining. In the second aspect of the invention, bleached pulp is transferred to secondary refining. In both aspects, a known refiner is used under known refining conditions to lower the pulp freeness to a desired level. This step is performed under pressure or at normal pressure, preferably using a conventional pressurized or atmospheric defibrator as a refiner at a concentration of about 4-60%.

In the first aspect of the invention, the pulp can be bleached by a known bleaching method after defibration by primary refining for collecting pulp fibers from the chips, or after beating by secondary refining for lowering the freeness to a desired level, or after both of these steps. In the second aspect of the invention, defibrated pulp is bleached after washing. In the first and second aspects of the invention, suitable bleaching agents include oxidizing agents such as hydrogen peroxide, ozone and peracetic acid or reducing agents such as sodium hydrosulfite (sodium dithionite), sodium hydrogen sulfate, sodium borohydride and formamidinesulfinic acid (FAS). In particular, peroxide bleaching greatly improves bleaching efficiency and brightness.

EXAMPLES

The following examples further illustrate the present invention without, however, limiting the invention thereto. The proportion of each reagent is expressed as the weight of solids on the basis of the bone dry weight of chips or pulp.

1. Chips Tested

Mixed chips of hemlock/pine=80/20 (bone dry weight ratio) were used as a material with normal bleachability. Single chips of Douglas fir were used as a materials having low bleachability.

2. Chemical Impregnation (First Aspect)

The chips were impregnated with sodium hydroxide or a chelating agent using an Impressafiner system at a compression ratio of 4:1.

3. Preparation Process of Pulp (1) Primary refining: Preheated chips were prepared at a concentration of 40% solids by weight and defibrated using a pressurized refiner (BPR45-300SS from Kumagai Riki Kogyo). The refining temperature was 133° C.

(2) Hydrogen peroxide bleaching conditions: To defibrated pulp after primary refining were added 1.2% sodium hydroxide and 1.3% sodium silicate, then 1.8% hydrogen peroxide. The bleaching treatment was performed at a concentration of 15% pulp solids, temperature of 80° C. for a residence time of 35 minutes.

(3) Secondary refining: Refining was performed to a freeness of 90 ml using an atmospheric refiner (BR-300CB from Kumagai Riki Kogyo) at a pulp concentration of 20% solids by weight.

4. Measurement of brightness: hand sheet was produced from thus prepared pulp to measure the Hunter brightness of the pulp.

Example 1

Chips of Douglas fir were impregnated with 1.50% sodium hydroxide. During the impregnation, the initial pH and the final pH were measured. Then, they were subjected to two types of treatment (primary refining)-(secondary refining) and (primary refining)-(hydrogen peroxide bleaching)-(secondary refining) and the brightness of the resulting pulp was measured. The results are shown in Table 1 and FIGS. 1 and 2.

Example 2

The same treatment and measurement as described in Example 1 were performed except that 0.50% sodium hydroxide was added. The results are shown in Table 1 and FIGS. 1 and 2.

Example 3

The same treatment and measurement as described in Example 1 were performed except that 0.10% sodium hydroxide was added. The results are shown in Table 1 and FIGS. 1 and 2.

Example 4

The same treatment and measurement as described in Example 1 were performed except that 0.05% sodium hydroxide was added. The results are shown in Table 1 and FIGS. 1 and 2.

Example 5

The same treatment and measurement as described in Example 1 were performed except that 0.01% sodium hydroxide was added. The results are shown in Table 1 and FIGS. 1 and 2.

Example 6

The same treatment and measurement as described in Example 1 were performed except that 0.01% sodium hydroxide was added and the initial pH was adjusted to 10.0 with dilute sulfuric acid. The results are shown in Table 1 and FIGS. 1 and 2.

Example 7

The same treatment and measurement as described in Example 1 were performed except that 0.01% sodium hydroxide was added and the initial pH was adjusted to 9.4 with dilute sulfuric acid. The results are shown in Table 1 and FIGS. 1 and 2.

Example 8

The same treatment and measurement as described in Example 1 were performed except that 0.01% sodium hydroxide was added and the initial pH was adjusted to 8.2 with dilute sulfuric acid. The results are shown in Table 1 and FIGS. 1 and 2.

Example 9

The same treatment and measurement as described in Example 1 were performed except that the chips were impregnated with 0.50% of a chelating agent diethylenetriaminepentaacetic acid (DTPA) in place of 1.50% sodium hydroxide. The results are shown in Table 1 and FIGS. 1 and 2.

Example 10

The same treatment and measurement as described in Example 1 were performed except that the chips were impregnated with 0.20% of a chelating agent diethylenetriaminepentaacetic acid (DTPA) in place of 1.50% sodium hydroxide. The results are shown in Table 1 and FIGS. 1 and 2.

Example 11

The same treatment and measurement as described in Example 1 were performed except that the chips were impregnated with 0.10% of a chelating agent diethylenetriaminepentaacetic acid (DTPA) in place of 1.50% sodium hydroxide. The results are shown in Table 1 and FIGS. 1 and 2.

Example 12

The same treatment and measurement as described in Example 1 were performed except that the chips were impregnated with 0.10% of a chelating agent diethylenetriaminepentaacetic acid (DTPA) in place of 1.50% sodium hydroxide and the initial pH was adjusted to 8.8 with dilute sulfuric acid. The results are shown in Table 1 and FIGS. 1 and 2.

Example 13

The same treatment and measurement as described in Example 1 were performed except that the chips were impregnated with 0.10% of a chelating agent diethylenetriaminepentaacetic acid (DTPA) in place of 1.50% sodium hydroxide and the initial pH was adjusted to 7.1 with dilute sulfuric acid. The results are shown in Table 1 and FIGS. 1 and 2.

Comparative Example 1

Chips of hemlock/pine=80/20 were subjected to two types of treatment (primary refining)-(secondary refining) and (primary refining)-(hydrogen peroxide bleaching)-(secondary refining) without impregnation and the brightness of the resulting pulp was measured. The results are shown in Table 1.

Comparative Example 2

The same treatment and measurement as described in Comparative example 1 were performed except that chips of hemlock/pine=80/20 were replaced by 100% Douglas fir with low bleachability. The results are shown in Table 1 and FIGS. 1 and 2.

Comparative Example 3

Chips of 100% Douglas fir were impregnated with a dilute sulfuric acid solution and subjected to two types of treatment (primary refining)-(secondary refining) or (primary refining)-(hydrogen peroxide bleaching)-(secondary refining) and the brightness of the resulting pulp was measured. The results are shown in Table 1 and FIGS. 1 and 2.

Comparative Example 4

The same procedures as described in Comparative example 3 were performed except that the chips were impregnated with water in place of dilute sulfuric acid. The results are shown in Table 1 and FIGS. 1 and 2.

TABLE 1

| | Wood type | Impregnating agent | % Added | Initial pH | Final pH | Brightness % before bleaching | Brightness % after bleaching |
|---|---|---|---|---|---|---|---|
| Example 1 | Douglas fir | NaOH | 1.50 | 13.4 | 13.2 | 20.5 | 31.4 |
| Example 2 | Douglas fir | NaOH | 0.50 | 13.0 | 12.6 | 23.6 | 32.5 |
| Example 3 | Douglas fir | NaOH | 0.10 | 12.4 | 11.1 | 27.3 | 36.2 |
| Example 4 | Douglas fir | NaOH | 0.05 | 11.9 | 10.0 | 27.0 | 45.1 |
| Example 5 | Douglas fir | NaOH | 0.01 | 11.4 | 7.6 | 34.4 | 48.1 |
| Example 6 | Douglas fir | NaOH | 0.01 | 10.0 | 5.7 | 35.6 | 47.5 |
| Example 7 | Douglas fir | NaOH | 0.01 | 9.4 | 5.3 | 34.9 | 47.1 |
| Example 8 | Douglas fir | NaOH | 0.01 | 8.2 | 5.2 | 35.8 | 45.6 |
| Example 9 | Douglas fir | DTPA | 0.50 | 11.9 | 10.4 | 32.0 | 50.7 |

TABLE 1-continued

| | Wood type | Impregnating agent | % Added | Initial pH | Final pH | Brightness % before bleaching | Brightness % after bleaching |
|---|---|---|---|---|---|---|---|
| Example 10 | Douglas fir | DTPA | 0.20 | 11.3 | 9.4 | 31.5 | 50.7 |
| Example 11 | Douglas fir | DTPA | 0.10 | 11.3 | 8.9 | 35.8 | 50.5 |
| Example 12 | Douglas fir | DTPA | 0.10 | 8.8 | 6.3 | 36.5 | 48.5 |
| Example 13 | Douglas fir | DTPA | 0.10 | 7.1 | 5.7 | 34.9 | 46.2 |
| Comparative example 1 | Hemlock/ Pine | — | — | — | — | 37.0 | 43.2 |
| Comparative example 2 | Douglas fir | — | — | — | — | 38.1 | 41.2 |
| Comparative example 3 | Douglas fir | Dilute $H_2SO_4$ | — | 2.5 | 2.7 | 33.5 | 42.7 |
| Comparative example 4 | Douglas fir | $H_2O$ | — | 7.2 | 5.0 | 31.5 | 42.7 |

The wood type of Comparative example 1 is hemlock-lpine=80/20 with normal bleachability. The wood type of Comparative example 2 is 100% Douglas fir, which is known to be hard to bleach. This is shown by the brightness of 41.2% after bleaching in Comparative example 2, which is 2.0% lower than the brightness of 43.2% in Comparative example 1. This shows that Douglas fir has low bleachability under the same treatment conditions.

Figure 2:
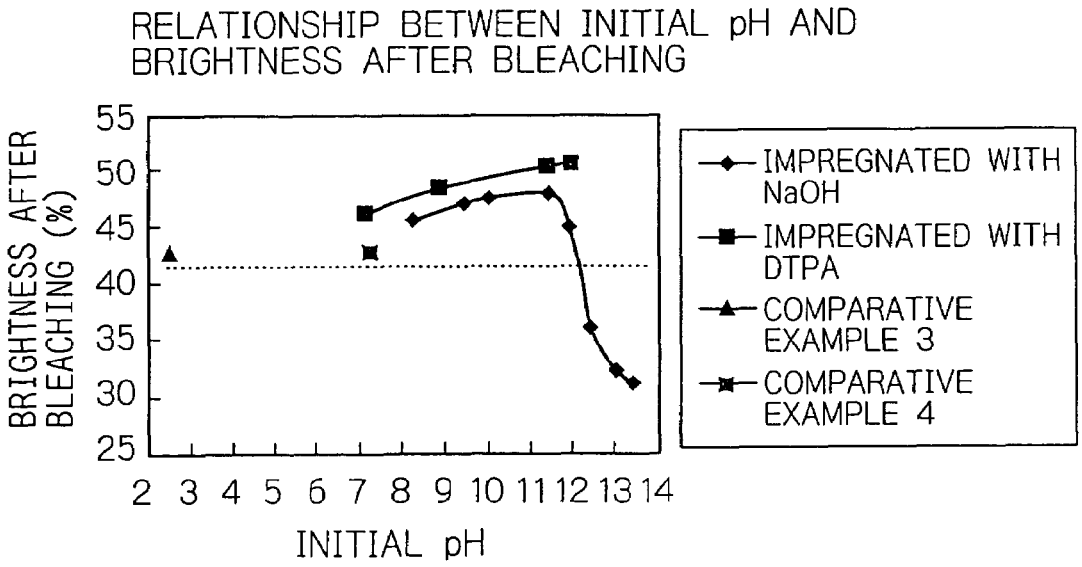
FIG. 2 is a graph showing the relationship between initial pH and brightness after bleaching.

FIG. 1 shows the relationship between the initial pH during extraction by chemical impregnation and the brightness of defibrated pulp before bleaching and after primary refining, revealing that the brightness before bleaching of pulp impregnated with sodium hydroxide (Examples 1-8) is rather lower than that obtained in Comparative example 2. Especially when the initial pH is about 11.5 or more, the brightness significantly decreases. However, the relationship between the initial pH and the brightness after bleaching shown in FIG. 2 reveals that the brightness at an initial pH range of about 12.0 or less is higher than that obtained in Comparative example 2. This suggests that the hydrogen peroxide bleaching reaction efficiently proceeded as a result of removal of extractives by impregnation with sodium hydroxide.

Impregnation with DTPA (Examples 9-13) showed a similar tendency to impregnation with sodium hydroxide. The brightness before bleaching in Examples 9-13 was rather lower than that obtained in Comparative example 2. However, the relationship between the initial pH and the brightness after bleaching shown in FIG. 2 reveals that the brightness is higher than that obtained in Comparative example 2. This suggests that metal ions and extractives detrimental to hydrogen peroxide bleaching were removed by impregnation with DTPA and, as a result, the hydrogen peroxide bleaching reaction efficiently proceeded.

The mechanism by which the brightness after bleaching is improved by impregnation with sodium hydroxide or impregnation with a chelating agent according to the first aspect of the present invention is unclear, but extractives such as flavonoids are known to be detrimental to bleaching of woods having low bleachability such as Douglas fir and representative known compounds thereof include dihydroquercetin and quercetin. This indicates that the bleachability with hydrogen peroxide was improved as a result of extraction of these substances by impregnation with sodium hydroxide. Flavonoids are known to form complexes with metal ions to cause coloration. Thus, it is concluded that the impregnation of chips with a chelating agent DTPA had the effect of extracting flavonoids by the alkalinity of DTPA, forming complexes of DTPA with metal ions contained in the chips and inhibiting the complexation of flavonoids with metal ions to suppress the decomposition of hydrogen peroxide and to improve the bleaching efficiency.

Example 14

Figure 3:
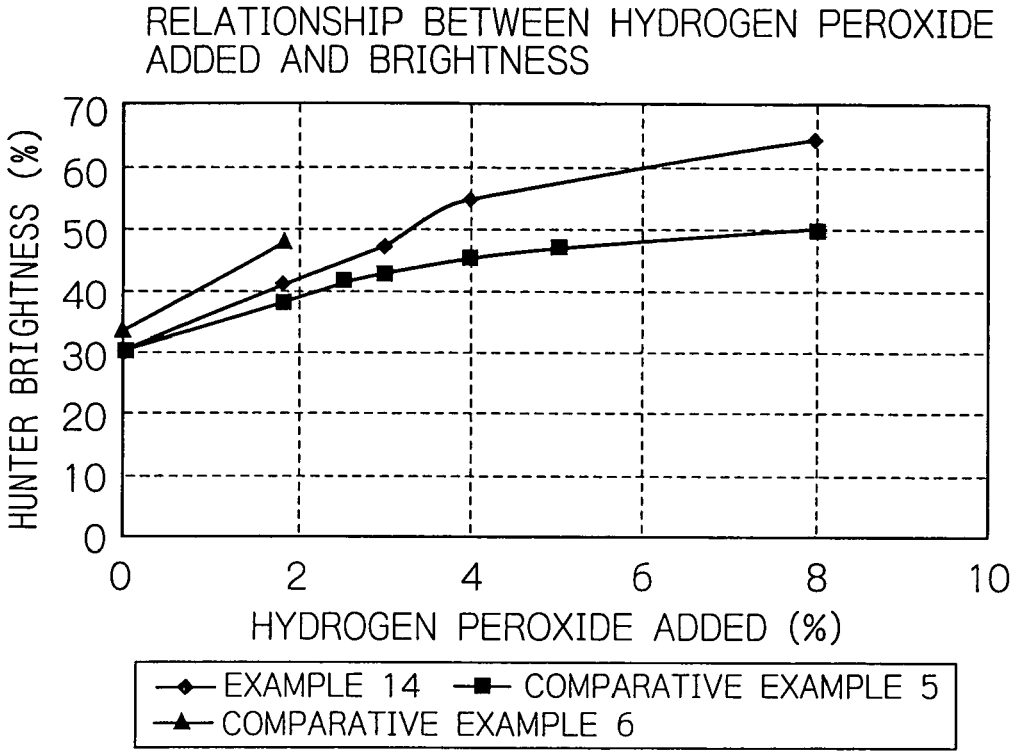
FIG. 3 is a graph showing the relationship between added hydrogen peroxide and brightness.

Chips of 100% Douglas fir with low bleachability were defibrated by primary refining at a concentration of 40% solids by weight and a temperature of 133° C. This was diluted with warm water at a temperature of 50° C. to a concentration of 1.0% solids by weight. Then, the slurry was concentrated/dehydrated to a concentration of 30% solids by weight in a dehydrator. The washing efficiency was 97.6%. The slurry was diluted again with warm water, bleached with hydrogen peroxide at a concentration of 15% solids by weight (with 1.8%, 3.0%, 4.0% and 8.0% hydrogen peroxide), and further beaten to a freeness of 95 ml by secondary refining. The Hunter brightness of the bleached mechanical pulp was measured after beating. The pulp not bleached with hydrogen peroxide was also subjected to secondary refining in the same manner. The results are shown in Table 2 and FIG. 3.

Comparative Example 5

Chips of 100% Douglas fir with low bleachability were defibrated by primary refining at a concentration of 40% solids by weight and a temperature of 133° C. This was diluted with warm water, bleached with hydrogen peroxide at a concentration of 15% solids by weight (with 1.8%, 2.5%, 3.0%, 4.0%, 5.0% and 8.0% hydrogen peroxide), and further beaten to a freeness of 95 ml by secondary refining. The Hunter brightness of the bleached mechanical pulp was measured after beating. The pulp not bleached with hydrogen peroxide was also subjected to secondary refining in the same manner. The results are shown in Table 2 and FIG. 3.

Comparative Example 6

Mixed chips of hemlock/pine=80/20 with normal bleachability were defibrated by primary refining at a concentration of 40% solids by weight and a temperature of 133° C. This was diluted with warm water, bleached with hydrogen peroxide at a concentration of 15% solids by weight (with 1.8%, 2.5%, 3.0%, 4.0%, 5.0% and 8.0% hydrogen peroxide), and further beaten to a freeness of 95 ml by secondary refining. The Hunter brightness of the bleached mechanical pulp was measured after beating. The pulp not bleached with hydrogen peroxide was also subjected to secondary refining in the same manner. The results are shown in Table 2 and FIG. 3.

TABLE 2

| | $H_2O_2$ added (%) | | | | | | | | |
|---|---|---|---|---|---|---|---|---|---|
| | 0 | 1.0 | 1.8 | 2.0 | 2.5 | 3.0 | 4.0 | 5.0 | 8.0 |
| Example 14 | 30.3 | | 41.0 | | | 47.0 | 54.5 | | 64.7 |
| Comparative example 5 | 30.3 | | 37.9 | | 41.3 | 42.7 | 45.2 | 46.7 | 49.7 |
| Comparative example 6 | 33.7 | | 47.5 | | | | | | |

Comparison of the brightness of the bleached mechanical pulp of Example 14 subjected to washing after primary refining with the brightness of Comparative example 5 without washing at the same concentrations of hydrogen peroxide shows that the brightness of Example 14 was greatly improved. This means that polyphenols responsible for low bleachability are removed by washing and, as a result, the hydrogen peroxide bleaching efficiency is greatly improved. For example, 5.2% hydrogen peroxide must be added in Comparative example 5 to attain a brightness of 47.5% comparable to that of the bleached mechanical pulp of Comparative example 6 obtained by adding 1.8% hydrogen peroxide to mixed chips of hemlock/pine=80/20 with normal bleachability, but only 2.9% hydrogen peroxide is required in Example 14 to attain the same brightness, which means that hydrogen peroxide can be reduced by as much as 44%.

Example 15

Figure 4:
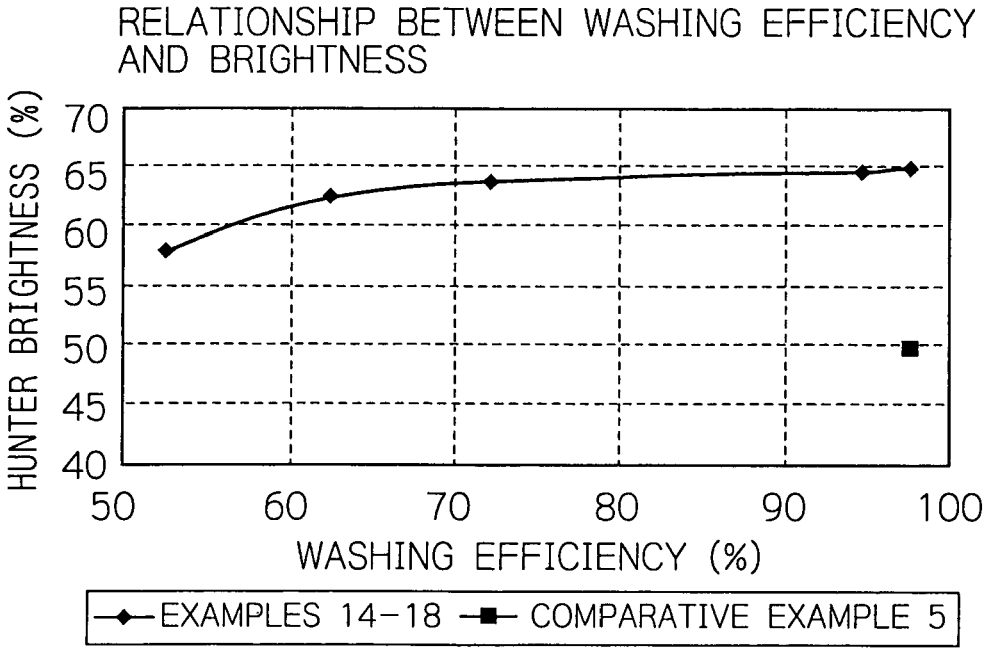
FIG. 4 is a graph showing the relationship between washing efficiency and brightness.

Chips of 100% Douglas fir with low bleachability were defibrated by primary refining at a concentration of 40% solids by weight and a temperature of 133° C. This was diluted with warm water at a temperature of 50° C. to a concentration of 1.0% solids by weight. Then, the slurry was concentrated/dehydrated to a concentration of 16% solids by weight in a dehydrator. The washing efficiency was 94.7%. The slurry was diluted again with warm water, bleached with hydrogen peroxide at a concentration of 15% solids by weight (with 8.0% hydrogen peroxide), and further beaten to a freeness of 95 ml by secondary refining. The Hunter brightness of the bleached mechanical pulp was measured after beating. The results are shown in Table 3 and FIG. 4.

Example 16

Chips of 100% Douglas fir with low bleachability were defibrated by primary refining at a concentration of 40% solids by weight and a temperature of 133° C. This was diluted with warm water at a temperature of 50° C. to a concentration of 3.0% solids by weight. Then, the slurry was concentrated/dehydrated to a concentration of 10% solids by weight in a dehydrator. The washing efficiency was 72.2%. The slurry was diluted again with warm water, bleached with hydrogen peroxide at a concentration of 15% solids by weight (with 8.0% hydrogen peroxide), and further beaten to a freeness of 95 ml by secondary refining. The Hunter brightness of the bleached mechanical pulp was measured after beating. The results are shown in Table 3 and FIG. 4.

Example 17

Chips of 100% Douglas fir with low bleachability were defibrated by primary refining at a concentration of 40% solids by weight and a temperature of 133° C. This was diluted with warm water at a temperature of 50° C. to a concentration of 4.0% solids by weight. Then, the slurry was concentrated/dehydrated to a concentration of 10.0% solids by weight in a dehydrator. The washing efficiency was 62.5%. The slurry was diluted again with warm water, bleached with hydrogen peroxide at a concentration of 15% solids by weight (with 8.0% hydrogen peroxide), and further beaten to a freeness of 95 ml by secondary refining. The Hunter brightness of the bleached mechanical pulp was measured after beating. The results are shown in Table 3 and FIG. 4.

Example 18

Chips of 100% Douglas fir with low bleachability were defibrated by primary refining at a concentration of 40% solids by weight and a temperature of 133° C. This was diluted with warm water at a temperature of 50° C. to a concentration of 5.0% solids by weight. Then, the slurry was concentrated/dehydrated to a concentration of 10.0% solids by weight in a dehydrator. The washing efficiency was 52.6%. The slurry was diluted again with warm water, bleached with hydrogen peroxide at a concentration of 15% solids by weight (with 8.0% hydrogen peroxide), and further beaten to a freeness of 95 ml by secondary refining. The Hunter brightness of the bleached mechanical pulp was measured after beating. The results are shown in Table 3 and FIG. 4.

Comparison of the brightnesses of Examples 14-18 with the brightness of Comparative example 5 at the same hydrogen peroxide concentration of 8.0% shows that the brightnesses of Examples 14-18 at washing efficiencies of 52.6-97.6% are higher than that of Comparative example 5. The brightness of Example 18, even at the lowest washing efficiency, is 8.4% higher than that of Comparative example 5. However, the brightness tends to sharply decrease from the washing efficiency around 50%.

TABLE 3

| | Concentration after dilution % | Concentration after dehydration % | Washing efficiency % | Brightness % |
|---|---|---|---|---|
| Example 14 | 1.0 | 30.0 | 97.6 | 64.7 |
| Example 15 | 1.0 | 16.0 | 94.7 | 64.5 |
| Example 16 | 3.0 | 10.0 | 72.2 | 63.6 |
| Example 17 | 4.0 | 10.0 | 62.5 | 62.5 |
| Example 18 | 5.0 | 10.0 | 52.6 | 58.1 |
| Comparative example 5 | 1.0 | 30.0 | 97.6 | 49.7 |

ADVANTAGES OF THE INVENTION

According to the present invention, mechanical pulps having high brightness can be prepared from even wood species previously considered to be unsuitable for mechanical pulps such as materials having low bleachability containing high levels of extractives. The present process can expand the application of wood species that were difficult to convert into mechanical pulp, thus greatly contributing to environmental protection in terms of more effective use of wood. Moreover, the amount of bleaching agents used can be reduced.

What is claimed is:

1. A process for preparing bleached mechanical pulp having high brightness from wood chips consisting essentially of the steps, in order, of impregnating wood chips having low bleachability with a chemical liquor consisting essentially of an aqueous solution of an alkaline inorganic compound and a chelating agent at a pH range of 7-12 and then removing said impregnating chemical liquor from said chips, next followed by the sequential steps, in order, of (a) defibration by primary refining, bleaching, and beating by secondary refining, or (b) defibration by primary refining, beating by secondary refining and bleaching, wherein the step of impregnating comprises compressing the chips, immersing the chips under compression or after compression in said chemical liquor and releasing pressure to impregnate them with said chemical liquor, and wherein the step of removing the impregnated chemical liquor comprises compressing the chips impregnated with said chemical liquor to drain the impregnating chemical liquor from the chips.

2. The process for preparing mechanical pulp according to claim 1 characterized in that the chemical impregnation step comprises compressing the chips at a compression ratio of 4:1-16:1 and releasing pressure to impregnate them with the chemical liquor and the step of removing the impregnating chemical liquor comprises compressing the chips impregnated with the chemical liquor at a compression ratio of 4:1-16:1 to drain the impregnating chemical liquor.

3. The process for preparing mechanical pulp according to claim 1 characterized in that said wood chips having low bleachability have high levels of flavonoids.

4. The process for preparing mechanical pulp according to claim 1 characterized in that the wood chips are single chips or mixed chips of two or more wood species having low bleachability selected from Larix, Pseudotsuga, Cryptomeria, Tsuga, Thuja and Pinus.

5. The process for preparing mechanical pulp according to claim 1 characterized in that the wood chips are single chips or mixed chips of two or more wood species having low bleachability selected from Larix, Pseudotsuga, Cryptomeria, Tsuga, Thuja and Pinus.

6. The process for preparing mechanical pulp according to claim 2 characterized in that the wood chips are single chips or mixed chips of two or more wood species having low bleachability selected from Larix, Pseudotsuga, Cryptomeria, Tsuga, Thuja and Pinus.

7. The process of claim 1, wherein removal of the impregnating chemical liquor from the chips is next followed by the sequential steps, in order, of defibration by primary refining, bleaching, and beating by secondary refining.

8. The process of claim 1, wherein removal of the impregnating chemical liquor from the chips is next followed by the sequential steps, in order, of defibration by primary refining, beating by secondary refining and bleaching.

9. A process for preparing bleached mechanical pulp having high brightness comprising the steps of in order (a) defibrating wood chips having low bleachability by primary refining, (b) washing pulp fibers formed by defibration such that defibrated pulp is diluted with water at a temperature of 5-95° C. to a concentration of 0.5-5.0 %, and is dehydrated by a press on a filter and such that the washing efficiency is 52.6-99.2 %, (c) bleaching the pulp fibers, and (d) further beating them by secondary refining to give bleached mechanical pulp having a Hunter brightness of 45-65%.

10. The process for preparing mechanical pulp having high brightness according to claim 9 characterized in that the wood chips are single chips or mixed chips of two or more hard bleaching wood species selected from Larix, Pseudotsuga, Cryptomeria, Tsuga, Thuja and Pinus.

11. The process for preparing mechanical pulp having high brightness according to claim 9 characterized in that the step of washing defibrated pulp comprises dilution with water at a temperature of 5-95° C. and dehydration by a press on a filter and the washing efficiency is 52.6-94.7%.

12. The process for preparing mechanical pulp having high brightness according to claim 9 characterized in that the step of bleaching defibrated pulp after washing comprises single-stage bleaching with an oxidizing agent or a reducing agent.

13. The process for preparing mechanical pulp having high brightness according to claim 10 characterized in that the step of bleaching defibrated pulp after washing comprises single-stage bleaching with an oxidizing agent or a reducing agent.

14. The process for preparing mechanical pulp having high brightness according to claim 11 characterized in that the step of bleaching defibrated pulp after washing comprises single-stage bleaching with an oxidizing agent or a reducing agent.

* * * * *